United States Patent [19]

Dickey et al.

[11] 4,192,758

[45] Mar. 11, 1980

[54] OVERBASED MAGNESIUM SULFONATE PROCESS

[75] Inventors: Charles R. Dickey, Covina; Paul M. Williamson, Garden Grove, both of Calif.

[73] Assignee: Bray Oil Company, Inc., El Monte, Calif.

[21] Appl. No.: 901,612

[22] Filed: May 1, 1978

[51] Int. Cl.[2] ..... C10M 1/40

[52] U.S. Cl. ..... 252/33; 252/18; 252/25; 252/33.4; 423/432

[58] Field of Search ..... 252/18, 25, 33, 33.4; 423/432

[56] References Cited

U.S. PATENT DOCUMENTS

| | | | |
|---|---|---|---|
| 1,573,632 | 2/1926 | Crowell | 423/432 |
| 2,003,208 | 5/1935 | MacIntire | 423/432 |
| 3,629,109 | 12/1971 | Gergel et al. | 252/33 |
| 3,706,665 | 12/1972 | Bell et al. | 252/18 |
| 3,853,774 | 12/1974 | Crocker | 252/18 |
| 3,857,790 | 12/1974 | Saunders et al. | 252/18 |
| 3,865,737 | 2/1975 | Kemp | 252/33.4 |
| 3,928,216 | 12/1975 | Saunders et al. | 252/33.4 |
| 4,065,396 | 12/1977 | Dickey et al. | 252/18 |

*Primary Examiner*—Arthur P. Demers

*Attorney, Agent, or Firm*—Thomas A. Schenach

[57] ABSTRACT

An improvement in the method of preparing high alkali value overbased magnesium sulfonate lubricant additives from commmercially available grades of magnesium oxide is disclosed.

22 Claims, No Drawings

OVERBASED MAGNESIUM SULFONATE PROCESS

BACKGROUND OF THE INVENTION

This invention relates to overbased lubricating oil additives. More particularly, it relates to an improved method of preparing overbased magnesium sulfonates with alkali values over 400 and low viscosities, starting from commercially available grades of magnesium oxide.

Although overbased additives have been used in lubricant formulations for many years, their structure is still a matter of some controversy and their preparation is a complex and highly unpredictable art. An overbased additive consists essentially of a dispersing agent dissolved in a diluent oil, in combination with substantial quantities of a basic compound, usually inorganic, in the form of a submicronic colloidal dispersion. The preparation of such dispersions is customarily referred to as "overbasing". Presumably the dispersing agent exists in the form of micelles, in which the colloidal particles of basic compound are incorporated. Numerous combinations of oil soluble dispersing agent and colloidally dispersed base have been prepared, but the most widely used are the overbased sulfonates. These comprise the calcium, barium, and magnesium salts of oil soluble sulfonic acids in combination with colloidally dispersed calcium, barium, and magnesium carbonates. When employed in a lubricant such as an automobile crankcase oil, the carbonate serves to neutralize potentially corrosive acidic contaminants formed either by oxidation of the oil or partial combustion of the fuel, while the oil soluble sulfonate, in addition to dispersing the carbonate, also functions as a detergent to maintain engine cleanliness, and moreover imparts some degree of rust protection to susceptible metal parts.

The requirements for a commercially acceptable overbased sulfonate are formidable. In general, it must have an alkali value (AV) of at least 250 milligrams of KOH per gram equivalent—that is, each gram of overbased sulfonate must be capable of neutralizing as much acid as 250 milligrams of potassium hydroxide. Simple chemical calculation will show that a "250 AV" overbased magnesium sulfonate must contain 19% by weight dispersed magnesium carbonate. Likewise, a "400 AV" overbased magnesium sulfonate must contain 30% magnesium carbonate. This carbonate must be in such a fine state of subdivision that it will not separate from the additive on standing and cannot be removed from the lubricant in which the additive is employed by simple in-line filtering devices such as the oil filter in an automobile. An acceptable overbased sulfonate will be clear and transparent to the naked eye, even though it contains 20–30% of a highly insoluble metal salt. Any haze or cloudiness signals the presence of large particles, which may settle out causing loss in neutralizing power and possible abrasion of metal surfaces. Furthermore, an acceptable overbased sulfonate must have a viscosity sufficiently low that it can be transferred and blended in a plant without trouble. This last requirement is not always simple to meet. As the concentration of dispersed carbonate is increased, there is a marked tendency for the additive to thicken, even to the point of gelation and, although a successfully fine colloidal dispersion may have been achieved, the product may be hopelessly intractable. Thus, although numerous methods have been proposed for the preparation of overbased sulfonates, relatively few are capable of producing an additive of high alkali value (250 or above) that is commercially acceptable. And, although calcium, barium, and magnesium are all alkaline earth metals, many of their compounds differ considerably in solubility and reactivity with the result that a process that will yield a useful overbased sulfonate of one of these metals will not necessarily be commercially successful when applied to another.

This fact is particularly apparent when dealing with magnesium. Calcium and barium overbased sulfonates can both be prepared from the corresponding oxides. The general method comprises forming a mixture of the oxide, water and/or alcohol, an alkylbenzene sulfonate salt in a diluent oil, and a petroleum solvent, adding thereto carbon dioxide until the oxide is converted to the carbonate, and then removing water, alcohol, solvent, and undispersed particles to obtain the overbased sulfonate product in the form of a colloidal dispersion in the diluent oil. Of course, the process is not as simple as this brief description may suggest. The objective is not merely to prepare calcium or barium carbonate by the reaction of the oxide with $CO_2$, but rather to prepare it in the form of a highly concentrated stable submicronic colloidal dispersion, transparent to the naked eye. Careful attention to temperature, solvent, type of oxide, type of dispersing agent, etc. is critical. Isolation of the product, if not carried out with scrupulous care, may cause coagulation of the colloidal carbonate particles or formation of an intractable gel. However, these problems have largely been overcome insofar as calcium and barium are concerned. Overbased calcium sulfonates of 250 AV or higher are routinely manufactured by various versions of the above oxide process.

Unfortunately, the oxide method has been considerably less successful when applied to magnesium. Hazy products with low AVs are often obtained, and much of the oxide ends up as undispersed solid which is difficult to filter. There are undoubtedly many reasons, but one of the biggest factors is the enormous variation in the activity of commercially available grades of magnesium oxide. Magnesium oxide (magnesia) is normally manufactured by high temperature decomposition (calcination) of various oreas—magnesite (magnesium carbonate), dolomite (a mixed carbonate of calcium and magnesium), or brucite (magnesium hydroxide). It has also been manufactured from magnesium chloride and magnesium sulfate. If the calcination is carried out at relatively high temperatures (e.g. 1600° C.), the resulting oxide is dense, refractory, and fairly inert chemically, and is customarily referred to as "dead burned" or "heavy" magnesia. Magnesium oxides prepared by calcination at lower temperatures (e.g. 600°–900° C.) are less dense and more reactive, and are usually referred to as "light", "active", or "caustic burned" magnesias. It is these latter grades which have normally been used in the attempted preparation of overbased magnesium sulfonates. However, there is considerable variation in the reactivity of different grades of "active" magnesia, depending on the exact calcination temperature employed, the composition and the quality of the ores calcined, etc. The total surface area, the microscopic pore diameter, and the crystal form may differ dramatically between two different "active" magnesias. Even the same grade of magnesium oxide from the same manufacturer may show significant variations in quality from one year to the next. Thus an overbasing procedure which works reasonably well with one form of "active" magnesium oxide may fail when a different oxide, or even a different lot of the "same" oxide, is used. Attempts have been made in the prior art to overcome this problem by the addition to the overbasing reaction mixture of "promoters" such as alcohols, ammonia, amines, and salts thereof, phenols, and naphthenic acids, in order to increase the reactivity of the magnesium oxide. However, these have not solved the basic problem—namely, that the manufacturer of overbased sulfonates usually has little or no control over the quality of the magnesium oxide on which the success of his process depends. Thus most commercially available magnesium overbased sulfonates have heretofore been manufactured, not from magnesium oxides, but from the more expensive magnesium metal. The metal is dissolved in an alcohol and simultaneously or subsequently contacted with carbon dioxide to form a soluble alkoxymagnesium carbonate complex, which is added to a magnesium alkylbenzene sulfonate in a petroleum diluent and hydrolyzed to the desired magnesium carbonate dispersion—see, for example, Hunt, U.S. Pat. No. 3,150,089 and Dickey, U.S. Pat. No. 3,761,411.

BRIEF STATEMENT OF THE INVENTION

We have now discovered an improved method whereby overbased magnesium sulfonates with alkali values of 400 or above and relatively low kinematic viscosities can be prepared by carbonation of commercial grades of "active" magnesium oxide in the presence of water and an oil soluble dispersing agent in spite of the considerable variations in activity of such oxides discussed hereinabove. Our invention resides in our discovery that for every magnesium oxide in a particular overbasing reaction mixture, there exists an optimum rate at which carbon dioxide should be added thereto, which is always less than the maximum rate at which the oxide could react with carbon dioxide under the reaction conditions employed. For example, whereas a given oxide in a given reaction mixture could be completely converted to the carbonate by contact with $CO_2$ for two hours, we have found that dramatic and unexpected improvements in the properties of the overbased sulfonate product can be achieved by limiting the amount of carbon dioxide supplied to the system so that the same amount of magnesium carbonate is formed at some slower rate—for example, in four hours or five. However, there is still a minimum rate at which the oxide must be carbonated in order to obtain a satisfactory product. If too slow a rate of carbonation is employed, the reaction mass may become gelatinous, and the final product hazy and undesirably viscous. So far as we are aware, the critical importance of the rate of carbonation to the success of an overbasing process employing commercial grades of magnesium oxide has not been realized heretofore in the prior art. We have named this optimum rate of $CO_2$ addition the "critical carbonation rate". We have found that, by determining the critical carbonation rate for a magnesium oxide in a given overbasing reaction mixture, we are able to prepare commercially suitable overbased products even from magnesium oxides heretofore regarded as unsuitable, and that problems occasioned by the variations in activity and quality of commercial magnesium oxides can be eliminated or at least dramatically reduced. Furthermore, we are able to prepare high AV products without the use of the customary promoters (methanol, ammonia, etc.), although, as will be shown, they may usefully be incorporated into our process and are considered preferred embodiments thereof.

PRIOR ART

The basic idea of forming an overbased additive by reacting an alkaline earth metal oxide or hydroxide with carbon dioxide in the presence of an oil-soluble dispersing agent and water is old in the art—see, for example, Warren, U.S. Pat. No. 2,839,470. Such processes have not been greatly successful with magnesium oxides, as already noted. The use of ammonia or amines in the preparation of overbased magnesium sulfonates is also well known—see Wright, U.S. Pat. No. 2,924,617. The use of lower alcohols such as methanol in the preparation of overbased additives is likewise old—see, for example, Carlyle, U.S. Pat. No. 2,956,018. So far as we are aware, no previous worker has disclosed the improvement which we claim as our invention—namely, the determination of a critical carbonation rate for the particular magnesium oxide being used under the particular overbasing conditions being employed. The following references are directed to the problem of preparing acceptable overbased magnesium sulfonates from commercial grades of magnesium oxide and are believed to be the closest prior art:

Gergel et al, U.S. Pat. No. 3,629,109, discloses a method for preparing overbased magnesium sulfonates by reacting "light" magnesium oxides with $CO_2$ in the presence of water or water-alcohol mixtures and alkylbenzene sulfonate dispersing agents. Preferred temperatures for carbonation are disclosed, but no criticality is claimed for the rate of $CO_2$ addition or of the advantages of "tailoring" it to the particular magnesium oxide being used. In order to prepare highly overbased additives, Gergel must employ a two- or multi-stage process wherein an overbased additive is prepared and isolated, mixed with more magnesium oxide and water, and again carbonated, and the sequence repeated until a product of the desired basic salt content is obtained. Using our process, comparable overbased sulfonates may be obtained with only one overbasing step, as will be shown hereinbelow. Gergel also admits experiencing some problems with hazy (and therefore commercially unacceptable) products when water alone is used without added alcohol. This problem is resolved when employing the improvement of our invention.

The following patents disclose processes which require the use of added "promoters", such as alcohol, ammonia, and amines, which are not necessary to our invention.

Kemp, U.S. Pat. No. 3,865,737, teaches a method comprising (1) forming an admixture of commercial magnesium oxide, oil soluble dispersing agent, volatile aliphatic hydrocarbon solvent, water, alcohol, and ammonia or an ammonium compound, (2) treating said mixture with at least one mole of carbon dioxide per mole of magnesium oxide, (3) adding a non-volatile diluent oil, and (4) removing the volatile materials. Kemp specifies the use of commercial grades of "light" magnesium oxides, but teaches that not all such oxides are satisfactory, and does not address himself to the problem of obtaining acceptable products from the unsatisfactory grades of oxide. (Using our improved process, we can prepare acceptable products from oxides regarded by Kemp as unsuitable, as will be shown hereinbelow.) Kemp's process is further limited in that only aliphatic hydrocarbon solvents are operable and the petroleum diluent oil must be added after the carbonation.

Saunders et al, U.S. Pat. No. 3,928,216, teaches forming in an inert solvent a reaction mixture of (1) an oil soluble detergent, (2) a basic alkaline earth compound such as magnesium oxide, (3) a hydroxy compound such as methanol, and (4) a promoter, an amine salt of an acid. The addition of water, though not claimed, is recommended. This mixture is treated with an acidic gas such as $CO_2$ to form the dispersed alkaline earth metal salt, and then heated to remove the volatile components. Either "light" or "heavy" magnesium oxide may be used, the "light" being slightly preferred. The rate, pressure, and temperature at which the $CO_2$ is to be added is not critical. Saunders' preferred amine salt promoter is ethylene diamine diformate.

Crocker, U.S. Pat. No. 3,853,774, employs naphthenic acids as promoters for the manufacture of overbased magnesium sulfonates using commercial grades of magnesium oxide. He states that "the least active form of magnesium oxide which gives economic metal utilization and yields a product of the desired alkalinity value is suitable for use in the process". There is no teaching of adjusting the rate of $CO_2$ addition in order to get better results with any given magnesium oxide.

The following patents also disclose various promoters in the manufacture of magnesium overbased sulfonates: Sabol et al, U.S. Pat. No. 3,524,814; Sabol et al, U.S. Pat. No. 3,609,076; Sabol et al, U.S. Pat. No. 3,126,340; Watson et al, U.S. Pat. No. 3,492,230.

Although many of the prior art references suggest rates at which the carbon dioxide may be added to their particular overbasing reaction mixtures, none discloses our discovery—that improved results can be obtained if the rate of carbonation is adjusted to the particular magnesium oxide in the particular reaction mixture being used.

DETAILED DESCRIPTION OF THE INVENTION

The key to our invention is the determination of the critical carbonation rate for the particular magnesium oxide being used under the particular reaction conditions being employed.

The critical carbonation rate may be defined as that rate of carbon dioxide addition necessary to maintain a $CO_2$ concentration in the system such that the rate of conversion of magnesium oxide to colloidally dispersed magnesium carbonate is at a maximum relative to the rate of conversion of magnesium oxide to undispersed products. We do not entirely understand why it is that limiting the amount of carbon dioxide available to the system should have such a beneficial effect on the quality of the final overbased product. The system is an exceedingly complex one. Just as there are numerous forms of magnesium oxide, there are several different forms of magnesium carbonate. For simplicity, it is customary to write magnesium carbonate simply as "$MgCO_3$". However, magnesium forms several basic carbonates as well as, for example:

$MgCO_3.Mg(OH)_2.3H_2O$ $3MgCO_3.Mg(OH)_2.3H_2O$ $4MgCO_3.MgO.5H_2O$ In addition, there are hydrated carbonates—for example:

$MgCO_3.3H_2O$ $MgCO_3.5H_2O$

These forms differ in their water solubility, and it is reasonable to assume that they also differ in the ease with which they can be incorporated into the micelle of an oil soluble sulfonate to form an overbased product. We do not know for certain which magnesium carbonate or carbonates are actually present in overbased magnesium sulfonate products. It may be that different carbonates are formed from different oxides or from the same oxide under different overbasing conditions. It is possible that, by carbonating a system at the critical carbonation rate, we are maintaining a $CO_2$ concentration which favors the formation of whichever form of magnesium carbonate can be most easily dispersed by the sulfonate present, with the result that a high-AV product is obtained.

Alternately, the critical carbonation rate may indicate, not the formation of a preferred species of easily dispersible carbonate, but rather, the establishment of an optimum transfer rate of magnesium salts from the surface of the starting magnesium oxide into the micelle of the sulfonate dispersing agent. When the surface of a crystal of magnesium oxide is contacted with water and carbon dioxide, magnesium hydroxide, carbonates, and bicarbonates can be formed. The rate of reaction, of course, depends on the reactivity of the oxide. The bicarbonates are fairly soluble in water, the carbonates are relatively insoluble, the hydroxide least soluble. Thus an increase in carbon dioxide concentration which tends to favor formation of the bicarbonate promotes transfer of magnesium from the solid oxide into the aqueous phase. Once in aqueous solution, the bicarbonate exists in equilibrium with the carbonate and the hydroxide: that is, $$2HCO_3^- = CO_3^{2-} + CO_2 + H_2O$$

$$CO_3^{2-} + H_2O = 2OH^- + CO_2.$$

Precipitation of magnesium carbonate and/or basic magnesium carbonates out of the aqueous phase will occur whenever the solubility product of one of these compounds is exceeded. This is affected by the concentration of $CO_2$ present, which, by favoring formation of the soluble bicarbonate, tends to inhibit precipitation. The rate of precipitation in turn determines the success of the overbasing process. As the precipitating crystals of magnesium carbonate begin to form, they must be "captured" by the micelles of the sulfonate dispersing agent before they have grown to excessive size. Thus the critical carbonation rate may be that rate sufficient to maintain a $CO_2$ concentration in the system low enough to permit precipitation of magnesium carbonates but high enough to prevent its precipitation from occurring at a rate faster than the growing crystals can be dispersed by the sulfonate.

Whatever the mechanism by which the critical carbonation rate affects the quality of the product, the determination of this rate for a given magnesium oxide in a given overbasing reaction mixture is well within the skill of the ordinary worker. Carbon dioxide may be introduced into a system in a variety of ways, and the uptake of $CO_2$ will be determined, not only by the activity of the oxide but, also, by the pressure at which the $CO_2$ is supplied, its solubility in the particular mixture of reactants being employed, the efficiency of agitation, the temperature, and so on. Thus, the simplest way to determine the critical carbonation rate for a given system is by a series of smallscale repetitive experiments, in which the rate of $CO_2$ addition is varied until the optimum AV product is obtained. For example, we might prepare the following reaction mixture:

(1) A commercial magnesium oxide, in an amount of about 15% to 400% in excess of that theoretically required to produce the desired alkali value in the final overbased sulfonate product;

(2) An oil soluble magnesium sulfonate, in an amount necessary to give a concentration of about 20 to 30% in the final overbased product;

(3) A diluent oil, in an amount necessary to give a concentration of about 30 to 50% in the final product;

(4) A low boiling hydrocarbon solvent, in an amount equal to about 70 to about 130% of the weight of the rest of the reactants;

(5) Water in an amount of from about 0.2 to 1.2 times the weight of the magnesium oxide. For fairly reactive oxides, it will be found that the amount of water required will be roughly equal to the weight of the magnesium oxide. Although it is possible to add all the water (5) to the initial mixture of (1) through (4), we prefer to begin the addition of the water simultaneously with the addition of the $CO_2$. This seems to aid in the control of the initial reaction rate. We normally add the water over a period of from about 2% to about 25% of the total reaction time.

We would then add carbon dioxide to this mixture by any convenient means (for example, by bubbling it through a gas inlet tube with good agitation) at a rate which theoretically should convert all the magnesium oxide present to the carbonate in some arbitrarily chosen period—for example, four hours. When the reaction of the carbon dioxide with the magnesium oxide is substantially complete, as indicated by the drop in temperature as the exothermic reaction subsides, we would then remove undispersed solids, water and hydrocarbon solvent, and determine the alkali value of the final overbased product. Alternatively, we might continue the addition of carbon dioxide to the system for a period of as long as 24 hours. This "post-carbonation" for some reason seems to make slight improvement in the quality of the final overbased sulfonate product. After this "post-carbonation" period, the product is isolated as indicated above. We would then repeat the experiment at lower and higher carbonation rates until the carbonation rate which yields the highest AV product had been determined. This is the critical carbonation rate for that particular oxide in that particular system.

As mentioned hereinabove, the use of promoters such as amines and lower alcohols is beneficial, and is considered a preferred embodiment. Ammonia and methanol are especially preferred. We have found it most desirable to use methanol in an amount equal to from about 0.5 to 1.5 volumes per volume of water, and add it to the initial reaction mixture. The water is then added as in the methanol free system while simultaneously beginning the addition of the $CO_2$. When ammonia is to be used, we use it in the form of dilute aqueous ammonium hydroxide (2–7%), adding it instead of the water. It is particularly beneficial to carbonate the ammonium hydroxide before addition. We first prepare a dilute solution of ammonium hydroxide and add carbon dioxide thereto until the initial exothermic reaction has subsided, or until the addition of phenolphthalein and excess aqueous barium chloride thereto fails to produce a pink color. This will be referred to hereinafter as carbonating to a phenolphthalein-barium chloride end point. This degree of carbonation corresponds roughly to a ratio of at least one mole of carbon dioxide to two moles of ammonia—that is, $(NH_4)_2CO_3$—however, other species such as ammonium bicarbonate and ammonium carbamate are undoubtedly present in equilibrium with the ammonium carbonate.

Alternatively, the methanol and dilute ammonium hydroxide may be combined and carbonated, and the resultant solution added to a mixture of magnesium oxide, magnesium sulfonate, diluent oil, and low boiling hydrocarbon solvent while simultaneously beginning $CO_2$ addition. However, we have found it preferable to have the methanol already present in the oxide-sulfonate reaction mixture and to add the carbonated ammonium hydroxide thereto.

To determine the critical carbonation rate for a given magnesium oxide in a reaction mixture incorporating ammonia and methanol as promoters, we might prepare the following reaction mixtures:

(1) The magnesium oxide, in an amount of about 15% to 400% in excess of that required by theory to produce the desired alkali value in the final overbased sulfonate product;

(2) An oil soluble magnesium sulfonate, in an amount necessary to give a concentration of about 20 to 30% in the final product;

(3) A diluent oil in an amount necessary to give a concentration of from about 30 to 50% in the final product;

(4) Methanol in an amount equal to about 0.5 to 1.5 times the volume of water to be used;

(5) A low boiling hydrocarbon solvent in an amount equal to about 70 to about 130% of the weight of the rest of the reactants.

In a separate reactor, we would carbonate a 2–7% aqueous solution of ammonium hydroxide until the initial exotherm had subsided. We would then add this solution, in an amount approximately equal to from 0.2 to 1.2 times the weight of the magnesium oxide employed, to the mixture of (1) through (5) above, in the usual manner, while simultaneously beginning the introduction of carbon dioxide at a rate which theoretically should convert all the magnesium oxide present to magnesium carbonate in some reasonable period—for example, two hours. When the carbonation reaction seems to be complete, as indicated by the end of the exothermic reaction, we would then remove undispersed solids, water, and solvent, and determine the alkali value of the final overbased product. As is well known in the art, prolonged contact with methanol seems to adversely affect the stability of overbased sulfonates. Thus when a methanol or alcohol promoter is used, we would not employ an excessively long "post-carbonation" period, as has been found beneficial in the nonpromoted systems. Rather, we would begin the product workup within an hour or two after the end of the exotherm. We would then repeat the experiment at lower and higher carbonation rates until that carbonation rate which yields the highest AV product (the critical carbonation rate) has been determined.

Once the crit.cal carbonation rate has been determined, the reaction can be scaled up and larger batches of 400 AV overbased magnesium sulfonate prepared with little, if any, change in reaction parameters. Those factors which might change the solubility of the $CO_2$ in the reaction mixture must, of course, be controlled, inasmuch as these affect the actual carbonation rate. Thus if, in the determination of the critical carbonation rate, the $CO_2$ were simply bubbled in at atmospheric pressure and allowed to pass out freely to the atmosphere, a similar method of $CO_2$ introduction must be used in the larger preparative runs. If the $CO_2$ is introduced by some other means, for example in a closed reactor under pressure which increases the solubility of the $CO_2$ in the system, the predetermined critical carbonation rate may no longer be applicable. In this connection, attention must also be paid to the rate of agitation. In preparing overbased magnesium sulfonates by our method, exceptionally vigorous agitation is not required. A rate of stirring that will maintain the magnesium oxide in a reasonable state of suspension during the reaction is sufficient. When determining the critical carbonation rate by repetitive experiments, however, it is important to use the same agitation rate, inasmuch as this will affect the rate at which the suspended magnesium oxide and carbon dioxide react. When scaling up, the agitation should, of course, be comparable to that used in the smaller runs wherein the critical carbonation rate was initially determined.

The carbonation may be carried out at any convenient temperature between ambient and the boiling point of the lowest boiling component in the reaction mixture. A suitable temperature range is between about 70° and 140° F. The reaction of the carbon dioxide with the magnesium oxide liberates heat, and means for removing this heat must be supplied if the reaction is to be carried out at a constant temperature. If feasible, we have found it advantageous to use a minimum of cooling and to use the rise in temperature of the batch as an indication of extent of reaction. When the reaction temperature has reached its maximum value and dropped again to within a few degrees of ambient, the carbonation is essentially over, and the post-carbonation and reaction workup can begin. Results obtained when the reaction temperature is allowed to rise in this manner are slightly better than those obtained when it is controlled at one specific temperature.

In working up the reaction mixture, we normally first heat to drive off most of the water and (if present) methanol and ammonia, while leaving most of the hydrocarbon solvent still in the mixture. The selection of a hydrocarbon solvent with a boiling point higher than that of water, or alternately, one which forms an azeotrope with water, is of obvious importance. The mixture is then filtered to remove undispersed solids. The use of so-called "filter aid" filtering clays is beneficial in facilitating the removal of the smaller particles. Alternately, the undispersed solids can be removed by centrifugation. Finally, the reaction mixture is heated again to drive off the hydrocarbon solvent, leaving the desired overbased sulfonate as a clear bright submicronic colloidal dispersion in the diluent oil.

A more complete discussion of reactants suitable for use in our invention follows hereinbelow:

SUITABLE REACTANTS (1) Magnesium Oxide

Any of the commercially available "light", "active", or "caustic burned" magnesium oxides may be employed. A major advantage of our invention is the fact that the less reactive grades of magnesium oxide may be used therein to produce high AV overbased sulfonates. However, less reactive grades have relatively low critical carbonation rates and will, therefore, require an extended period of time for reaction. Moreover, such oxides usually contain substantial amounts of "dead burned" or otherwise inert material which will not carbonate at all under conventional overbasing conditions; hence, more oxide must be added to the reaction mixture in order to obtain the desired high AV product, and more undispersed solids must be removed from the mixture when the reaction is over.

Occasionally an "active" grade of oxide is found which will not produce a high AV product at any rate of carbonation when only 15 to 30% excess oxide is employed. In such cases, we may use as much as 100 to 400% more than that theoretically required to produce the desired AV product. When such large excesses of oxide are used, we will normally use a smaller water to magnesium oxide ratio—eg. 0.2—and increase the addition time of the water. When using a carbonated ammonium hydroxide solution as promoter, we would also increase the addition time of said solution—for example, from about half an hour to an hour or even an hour and a half. Economic considerations will often dictate whether it is desirable to employ such oxides in an actual plant operation; however, from a purely technical standpoint, they are still suitable in the process of our invention.

(2) Oil Soluble Magnesium Sulfonates

The oil soluble sulfonic acids and salts thereof are well known in the art. Most commonly employed are those prepared by the sulfonation of alkyl benzenes having a molecular weight of from about 300 to about 750. Suitable alkyl benzenes may be of either natural or synthetic origin. Petroleum fractions in the lubricating oil range often contain alkyl benzene components which can be converted into oil soluble sulfonic acids by treatment with oleum. Such terms as "petroleum sulfonates" and "mahogany sulfonates" refer to such naturally derived oil soluble sulfonates. Alternately, alkyl benzenes in the suitable molecular weight range may be prepared synthetically by reacting benzene with chloroparaffins or olefins using Friedel-Crafts catalysts such as aluminum chloride. Suitable alkyl benzenes are sometimes available as byproducts of other chemical processes. For example, in the manufacture of household laundry detergents, benzene is alkylated with a mixture of $C_{10}$–$C_{15}$ chloroparaffins. The major product, the monoalkyl benzene ("linear alkylate") is sulfonated and neutralized with sodium hydroxide to form a water soluble detergent. The byproduct bottoms fraction, comprising dialkyl benzenes, dialkyl tetralins, and diphenyl alkanes can be sulfonated and neutralized, for example with magnesium oxide, to form an oil-soluble sulfonate dispersing agent. We frequently find it advantageous to employ a mixture of two or more different sulfonates, for example, a naturally derived petroleum sulfonate in combination with a synthetic, in carrying out our invention. Such combinations seem to exhibit enhanced dispersancy and solubility characteristics. Sometimes, we may employ the sulfonic acid instead of the sulfonate, adding to the reaction mixture a sufficient excess of magnesium oxide to neutralize the sulfonic acid to magnesium sulfonate in situ. Alternately, we may employ the ammonium salt of the sulfonic acid, using enough of an excess of the magnesium oxide to convert the ammonium to the magnesium sulfonate and liberate ammonia, which can then function as a promoter. Or we may employ some other sulfonate salt: for example, the calcium or the barium sulfonate. All these variations are contemplated as being within the scope of our invention.

Although the sulfonates of alkyl benzenes are most commonly employed in the manufacture of overbased additives, other oil soluble sulfonates with dispersancy properties, such as the dinonyl naphthalene sulfonates, are also useful. As is well known, there are many other oil soluble dispersants in addition to the sulfonates: for example, alkylated phenol salts (phenates) and high molecular weight carboxylic acid salts. These could be employed in place of part or all of the sulfonate in our invention. However, the sulfonates are preferred, and the discussion will be limited thereto.

The term "neutral sulfonate" is often used to differentiate a simple sulfonic acid salt such as the alkylbenzene sulfonates discussed hereinabove from an overbased sulfonate, such as those prepared by our invention.

(3) Diluent Oil

Inasmuch as both neutral and overbased sulfonates are normally glassy semisolids in their pure states, they are normally supplied and handled as solutions in a diluent oil. Usually, the diluent oil is a petroleum lubricating oil such as a 75- or 100-second neutral oil. For special applications, synthetic lubricants such as the alpha-olefin oligomer oils, the dialkylbenzenes, and lubricant esters may be employed. Sometimes the diluent oil is a byproduct from the manufacture of the neutral sulfonate. For example, a petroleum oil may be partially sulfonated to form an oil soluble sulfonic acid. That portion of the oil which did not react with the sulfonating reagent becomes the diluent for the sulfonic acid and the salt produced therefrom. Inasmuch as neutral sulfonates are normally handled in a diluent oil, no additional oil may be required in carrying out our overbasing process. The selection of the diluent oil is deemed to be within the skill of the ordinary worker in the art.

(4) Low Boiling Hydrocarbon Solvent

Unlike the process of Kemp which, as will be remembered, is operable only with an aliphatic hydrocarbon solvent, our process may be carried out with either an aliphatic or an aromatic solvent. Suitable examples are toluene, xylene, octane, and varnish-maker's and painter's naphtha (VM&P naphtha). A boiling point higher than that of water is advantageous inasmuch as the water is to be removed from the reaction mixture before the solvent; however, a lower boiling solvent capable of forming an azeotrope with water would also be suitable. Certain volatile halogenated hydrocarbon solvents could also be employed but are considered less desirable. As with the diluent oil, the selection of a suitable volatile hydrocarbon solvent is considered to be within the skill of the ordinary worker.

(5) Promoters

The use of methanol and ammonia as promoters in our process has already been discussed. In place of the methanol, other low boiling alcohols such as ethanol and isopropanol, and alkoxyalcohols such as the monomethyl ether of ethylene glycol can be used. In place of ammonia, amines such as trimethylamine and ethylenediamine may be used. Alkanolamines such as ethanolamine which combine the alcohol and ammonia functionality in the same molecule are also suitable promoters.

It should be noted that some prior art references refer to water as a promoter. We regard water more as a solvent and reactant. Ammonia is known to increase the water solubility of magnesium hydroxide and certain magnesium salts and this is possibly the reason for its beneficial effects in overbasing. The methanol may have several functions: that of lowering the surface tension of the water, thereby facilitating the wetting of the magnesium oxide surface; increasing the solubility of the carbon dioxide in the system; increasing contact between the oil and water phases; forming a transitory intermediate on the surface of the oxide, etc.

REACTANT RATIOS

Reactant ratios have already been discussed briefly hereinabove. The magnesium oxide is employed in an excess over that calculated to form overbased product of the desired alkali value, inasmuch as even the most active commercial grades of magnesia do not give 100% conversions to colloidally dispersed carbonate. The magnesium sulfonate dispersing agent is employed in an amount that will give a 20 to 30% concentration in the final product. If too little dispersing agent is present, there will be a tendency for the product to be thick or hazy, due to the presence of poorly dispersed magnesium carbonate particles. On the other hand, the use of too much dispersing agent is unattractive from an economic standpoint. The ratio of magnesium carbonate to neutral magnesium sulfonate in an overbased sulfonate can be expressed by either the "base ratio" or the "metal ratio". The base ratio is defined as the ratio of the equivalents of basic metal (in this case, the equivalents of magnesium in the form of magnesium carbonate) to the equivalents of neutral metal (in this case, the equivalents of magnesium in the form of neutral sulfonate). The metal ratio is defined as the ratio of the total equivalents of metal (basic plus neutral) to the equivalents of neutral metal. The better the dispersing capability of the sulfonate, the higher the base and metal ratio that can be obtained. For example, calculations will show that a representative 400 AV overbased sulfonate prepared by our process and containing 25% neutral magnesium sulfonate with a molecular weight of 944 would have a base ratio of about 14 and a metal ratio of about 15. Base ratio and metal ratio are somewhat cumbersome to use, but are seen frequently in the prior art.

The amount of diluent oil required will depend on the concentrations of magnesium carbonate and magnesium neutral sulfonate desired in the final product. Often the amount already present in the neutral sulfonate will be sufficient and no further oil will be required, as we have already noted.

The amount of water required is approximately equal to the amount that can be dissolved or dispersed by the magnesium sulfonate dispersing agent plus that required to convert the active portion of the magnesium oxide to magnesium hydroxide. We have found that most of the neutral sulfonates suitable for use in our process dissolve or disperse approximately the same amount of water (10–15% by weight of neutral sulfonate plus diluent oil). However, in view of the enormous number of neutral sulfonates and other oil soluble dispersing agent which might be employed in our process, it might prove necessary for a skilled worker to adjust the amount of water slightly in order to achieve optimum results with some particular dispersing agent.

The amount of low boiling hydrocarbon solvent is not critical. We normally employ said solvent in an amount approximately equal to the weight of the rest of the components in the reaction mixture—however, the use of 30% more or less does not usually harm the process. From a manufacturing standpoint, when relatively low amounts of solvent are employed, the reaction mixture will be more viscous and consequently more difficult to stir and filter. When excessive solvent is used, the effective batch size is decreased and solvent removal from the final product will be prolonged. A skilled worker will have no trouble finding a satisfactory level of solvent concentration within the above guidelines.

When dilute ammonium hydroxide is employed instead of water, it is employed as a dilute aqueous solution containing from about 2 to about 7% $NH_3$ with 3–4% preferred. When methanol is used, we add it in a volume roughly equal to the volume of the water used. A range of about 0.5 to 1.5 volumes per volume of water is suitable. Inasmuch as the addition of methanol or other alcohol or alkoxyalkanol promoter is not essential to our process, there is no critical minimum. However, we prefer not to exceed the upper limit of 1.5 volumes methanol per volume of water. Higher methanol concentrations are believed to lead to the formation of soluble methoxymagnesium carbonate complexes, such as are formed when magnesium metal is dissolved in methanol and carbonated. These complexes must be hydrolyzed to dispersed carbonate by treatment with water or steam and this could require the addition of extra steps to the process.

A representative recipe for making a 400–450 AV overbased magnesium sulfonate according to our process is shown in Table I. (The concentrated $NH_4OH$ is added to the water and carbonated to the phenolphthalein-barium chloride end point, as already noted.)

Table I

| Sample Overbasing Recipe | |
|---|---|
| Water 42 milliliters | (35–45 ml suitable) |
| Concentrated (29%) Ammonium Hydroxide 5 milliliters | (0–10 ml suitable) |
| Magnesium Oxide | 38 grams |
| Neutral Magnesium Alkylbenzene Sulfonate (mol. wt. 944) | 55 grams |
| Petroleum Diluent Oil | 90 grams |
| Xylene 300 milliliters | (200–400 ml suitable) |
| Methanol 40 milliliters | (0–60 ml suitable) |

Assuming 100% of the magnesium oxide is converted into dispersed magnesium carbonate, the overbased magnesium sulfonate product from this recipe would have an alkali value of 470, a base ratio of 16, and a metal ratio of 17. In practice, few commercial grades of magnesium oxide would give 100% conversions as already noted.

Our invention will now be illustrated by some representative examples, using various commercial "active" magnesium oxides. (It will be remembered, of course, that there is an enormous variation in the actual reactivity of different "active" magnesium oxides, at least insofar as overbasing is concerned.)

EXAMPLE 1

Relatively Reactive Oxide in a Promoted System

This Example illustrates the determination of the critical carbonation rate for oxide "A", a commercial "active" magnesium oxide of relatively high reactivity manufactured by the Kaiser Chemical Company. A promoted system with both ammonia and methanol was employed. The ammonium hydroxide-water mixture was pre-carbonated in a separate vessel until the initial exotherm had subsided, which corresponds to the phenolphthalein-barium chloride end point, as already noted. The neutral magnesium sulfonate was obtained from Calumet Petrochemicals, Inc. It was prepared by the magnesium oxide neutralization of a mixture of 70% dialkylbenzene sulfonic acids and 30% petroleum sulfonic acids, the latter being obtained from the sulfonation of a 600 Neutral oil. Its average molecular weight was approximately 950. The neutral sulfonate was diluted with a 100-second lubricant base oil to a concentration of 1% magnesium. No additional diluent oil was added to the batch, the diluent oil in the neutral sulfonate being sufficient. The recipe was essentially that shown in Table I.

The procedure was as follows: 38.5 grams of magnesium oxide "A", 145 grams of neutral magnesium sulfonate solution, 300 milliliters of xylene, and 40 milliliters of methanol were charged to a 2-liter round-bottomed flask equipped with a distilling head, a thermometer, a Teflon paddle stirrer, an addition funnel, and a gas inlet tube. The mixture was agitated at a rate sufficient to keep the magnesium oxide in suspension (approximately 150 rpm). A solution of 5 milliliters of concentrated ammonium hydroxide in 42 milliliters of water, pre-carbonated to the phenolphthalein-barium chloride end point, was added over a period of 30 minutes while simultaneously beginning the introducing of carbon dioxide gas through a rotameter into the gas inlet tube. When the exothermic reaction had subsided, introduction of carbon dioxide was continued for an additional hour ("post-carbonation") and then the reaction mixture was subjected to distillation up to 300° F. to remove water, ammonia, and methanol. Undispersed solids were then removed by suction-filtration through a bed of filteraid clay on an 18-cm. filter paper, and the filtered solution subjected to further distillation up to 400° F. in a stream of nitrogen to remove residual xylene and recover the overbased magnesium sulfonate product as a clear bright submicronic colloidal dispersion in diluent oil. The experiment was then repeated three times at lower and higher rates of $CO_2$ addition. The results are given in Table II.

Table II

| Run Number | 1 | 2 | 3 | 4 |
|---|---|---|---|---|
| $CO_2$ rate, ml/min | 130 | 96 | 82 | 59 |
| Exotherm, min | 220 | 280 | 360 | 320 |
| Filtration Time, secs. | 80 | 110 | 190 | 271 |
| Final Product | | | | |
| Alkali Value (AV) | 306 | 371 | 406 | 364 |
| Vis. @ 210° F., cSt. | 41.65 | 52.74 | 58.22 | 66.57 |
| Yield, MgO | 50.3% | 65.2% | 73.4% | 61.0% |

These results graphically illustrate the unexpected discovery of our invention which we have named the "critical carbonation rate". Magnesium oxide "A" is relatively reactive in overbasing, and commercially acceptable products were obtained in all four runs. However, a dramatic improvement was realized by dropping the $CO_2$ addition rate from 130 to 82 ml/min—namely, an increase in AV from 306 to 406, and an increase in yield of dispersed magnesium carbonate from 50.3 to 73.4. However, further reduction in the $CO_2$ addition rate from 82 to 59 ml/min caused a drop both in AV and in yield. Moreover, the 210° F. viscosity of the product of Run 4 (AV 364) was actually higher than that of the 406 AV product of Run 3, and a longer filtration time was required. Thus, the "critical carbonation rate" for this particular magnesium oxide in this particular overbasing reaction mixture seems to lie around 82 ml per 38.5 grams MgO.

EXAMPLE 2

Relatively Unreactive Oxide in a Promoted System

In this Example, a relatively unreactive oxide, Oxide "B", supplied by the Basic Chemical Company, was used. This magnesium oxide had a bulk density of over 30 pounds per cubic foot. It would be considered, therefore, as unsuitable by Kemp, cited hereinabove in the Prior Art section, who teaches that a bulk density of less than 20 pounds per cubic foot is required for the active magnesium oxides operable in his process. As in Example 1, methanol and pre-carbonated ammonium hydroxide were used as promoters, and the same neutral magnesium sulfonate from Calumet Petrochemicals, Inc. was the dispersing agent. However, in this series, the amount of magnesium oxide and the time of ammonium hydroxide addition were varied in some of the runs.

TABLE III

| Run Number | 1 | 2 | 3 | 4 | 5 |
|---|---|---|---|---|---|
| Magnesium Neutral Sulfonate, gms. | 145 | 145 | 145 | 145 | 145 |
| Xylene, mls. | 300 | 300 | 300 | 300 | 300 |
| Methanol, mls. | 40 | 40 | 40 | 40 | 40 |
| Ammonium Hydroxide (29%), mls. | 5 | 5 | 5 | 5 | 5 |
| Water, mls. | 42 | 42 | 42 | 42 | 42 |
| Magnesium Oxide, gms. | 40 | 40 | 160 | 40 | 52.6 |
| Time of $NH_4OH$ Addition, min. | 30 | 30 | 30 | 60 | 60 |
| $CO_2$ Addition, mls./min | 130 | 82 | 82 | 59 | 59 |
| Exotherm, min. | 170 | 240 | 280 | 300 | 330 |
| Filtration Time, Sec. | 1500 | 90 | 730 | 65 | 100 |
| Final Product | | | | | |
| Recovery, gm. | 156.7 | 169.6 | 187.5 | 184.4 | 197.3 |
| % Yield, MgO | 25.1% | 39.2% | 17.2% | 57.8% | 55.2% |
| Alkali Value (AV) | 170 | 245 | 410 | 349 | 410 |
| Vis. @ 210° F., cSt. | 31.9 | 34.27 | 69.8 | 56.09 | 78.29 |

From Runs 1 and 2, it can be seen that, dropping the rate of $CO_2$ addition from 130 to 82 ml/min., improved the yield and the AV, and especially the ease of filtration, of the final overbased product. However, the AV of the product of Run 2 (245) would be only marginally acceptable in a commercial product. By using the same carbon dioxide addition rate and quadrupling the charge of magnesium oxide "B", a 410 AV product was obtained (Run 3), but the filtration time was excessively long and, of course, the overall yield of dispersed magnesium carbonate was quite low. In Run 4, the $CO_2$ addition rate was lowered to 59 ml/min., and the carbonated ammonium hydroxide solution was added over a 60 instead of a 30 minute period. (Inasmuch as this solution also supplies some $CO_2$ to the reaction mixture, lengthening the addition time has the effect of further reducing the $CO_2$ addition rate.) As a result of these changes, a 349-AV product was obtained with excellent filterability and a relatively low 210° F. viscosity (Run 4). By adjusting the amount of Oxide "B" from 40 to 52.6 grams, a 410-AV product was obtained in Run 5.

This series illustrates that using the critical carbonation rate, it is possible to obtain high-AV products from active grades of magnesium oxide thought to be unsuitable by Kemp.

EXAMPLE 3

Highly Reactive Oxide in a Promoted System

In this Example, a highly reactive "active" magnesium oxide, Oxide "C", a developmental sample supplied by Merck & Co., Inc. was employed. The apparatus, reactants, and conditions were essentially the same as in Example 1. The results are listed in Table IV.

TABLE IV

| Run Number | 1 | 2 | 3 |
|---|---|---|---|
| $CO_2$ Rate, ml/min. | 59 | 82 | 130 |
| Exotherm, min. | 210 | 260 | 150 |
| Filtration Time, sec. | 158 | 81 | 124 |
| Final Product | | | |
| Recovery, gms. | 204.4 | 208.9 | 201.5 |
| % Yield, MgO | 89.7% | 93.4% | 87.2% |
| Alkali Value (AV) | 462 | 478 | 424 |
| Vis. @ 210° F., cSt. | Gels | 5191 | 71.8 |

With this unusually reactive oxide, the use of a relatively slow rate of $CO_2$ addition (59 ml/min) resulted in an intractable gel (Run 1). When the $CO_2$ rate was increased to 82 ml/min, a better yield of a higher-AV product was obtained, but, although the product was not a gel, it was still undesirably viscous (Run 2). On further increasing the $CO_2$ addition rate to 130 ml/min, a fully acceptable product was obtained. (It is suspected that the critical carbonation rate in this system actually lies somewhere in-between the rates of Run 2 and Run 3.)

EXAMPLE 4

Oxide of Medium Reactivity in a Promoted System

Magnesium Oxide "D" was also obtained from Merck & Co. It had a bulk density of around 21 pounds per cubic foot and an iodine number of 135, which suggests it would be unsuitable or only marginally operative in the process of Kemp. By using the critical carbonation technique of our invention, however, it can be made to yield products with high AVs and relatively low viscosities, as shown in Table V. The neutral sulfonate and carbonated ammonium hydroxide solutions were the same as in Example 1.

TABLE V

| Run Number | 1 | 2 | 3 | 4 |
|---|---|---|---|---|
| Oxide "D", gms. | 35.0 | 38.5 | 38.5 | 38.5 |
| Magnesium Neutral Sulfonate, gms. | 145 | 145 | 145 | 145 |
| Xylene, mls. | 300 | 300 | 300 | 300 |
| Methanol, mls. | 40 | 40 | 40 | 40 |
| Ammonium Hydroxide (29%), mls. | 5 | 5 | 5 | 5 |
| Water, mls. | 42 | 42 | 42 | 42 |
| Time of $NH_4OH$ Addition, min. | 30 | 30 | 30 | 60 |
| $CO_2$ Addition, mls/min. | 96 | 96 | 82 | 59 |
| Exotherm, min. | 270 | 250 | 240 | 280 |
| Filtration Time, sec. | 60 | 70 | 83 | 77 |
| Final Product | | | | |
| Recovery, gms. | 191.3 | 192.3 | 196.7 | 198.6 |
| Alkali Value (AV) | 387 | 397 | 418 | 432 |
| Vis. @ 210° F., cSt. | 64.77 | 69.75 | 68.64 | 129.9 |

EXAMPLE 5

Relatively Unreactive Oxide in a Non-promoted System

Whereas the use of promoters such as methanol and ammonia is considered to be a preferred embodiment of our invention, the critical carbonation rate techniques may be usefully applied to non-promoted systems. This series employed the relatively unreactive Oxide "B" used in Example 2. The neutral magnesium sulfonate solution was the same as in previous examples. An 18 hour "post-carbonation" period was employed in each run. In this series, the apparatus of Example 1 was modified slightly, in that the carbon dioxide which was not taken up by the reaction mixture was allowed to vent to the atmosphere through a restricted orifice, which had the result of maintaining a very slight positive pressure of $CO_2$ on the system.

TABLE VI

| Run Number | 1 | 2 | 3 | 4 | 5 | 6 |
|---|---|---|---|---|---|---|
| Magnesium Oxide "B", gms. | 159 | 159 | 159 | 159 | 159 | 159 |
| Neutral Magnesium Sulfonate, gms. | 290 | 290 | 290 | 290 | 290 | 290 |
| Xylene, mls. | 600 | 600 | 600 | 600 | 600 | 600 |
| Water, mls. | 84 | 84 | 84 | 84 | 84 | 84 |
| Time of Water Addition, min. | 120 | 120 | 120 | 120 | 120 | 120 |
| $CO_2$ Addition, mls/min. | 9 | 12 | 17 | 23 | 30 | 40 |
| Exotherm, min. | 390 | 420 | 430 | 450 | 390 | 330 |
| Final Product | | | | | | |
| Recovery, gms. | 306.9 | 330.2 | 321.9 | 333.8 | 323.3 | 306.1 |
| Alkali Value (AV) | 167 | 230 | 232 | 243 | 218 | 154 |
| Yield | 11.6% | 17.2% | 16.9% | 18.2% | 16.0% | 10.6% |

The phenomenon we have called the "critical carbonation rate" is again graphically illustrated by the above data. As the rate of $CO_2$ addition is increased from 9 to 23 ml/min., the alkali value of the product likewise increases from 167 to 243. A further increase in the $CO_2$ addition rate, however, causes a decrease in alkali value. Thus, for Oxide "B" in this overbasing reaction mixture, the critical carbonation rate lies around 23 mls/min.

The product of Run 4, with its AV of 243, would be only marginally acceptable as a commercial product. In operating with relatively unreactive grades of "active" magnesium oxide such as "B", a promoted process is recommended if AVs in excess of 300 or 400 are desired. When more reactive grades of oxides are used, however, AVs in excess of 400 may be obtained with no added promoters if the critical carbonation rate technique of our invention is employed. This is illustrated by Example 6.

EXAMPLE 6

Relatively Reactive Oxide in a Non-promoted System

In this series, a relatively reactive grade of magnesium oxide, Oxide "E", obtained from the Van Waters & Rogers Company, was used in a non-promoted system. Seventy-six grams of Oxide "E", 290 grams of the neutral magnesium sulfonate solution of Example 1, and 130 milliliters of xylene were charged to the reaction flask. Carbon dioxide addition was started and 60.5 milliliters of water were added over a period of 110 minutes. The exotherm lasted for approximately 420 minutes. Carbon dioxide addition was continued for a total of 23.5 hours. At a carbon dioxide rate of 23 mls/min., 178 grams of a 403 AV overbased magnesium sulfonate product were obtained.

This series clearly demonstrates the superiority of our improved process over the prior art reference Gergel et al, cited hereinabove. Gergel teaches that, if it is desired to prepare an overbased magnesium sulfonate having a metal ratio in excess of about 5 or 6, a modified procedure should be used employing alcohol as a co-promoter. The product of Example 6 has a metal ratio of about 10 and was prepared without the use of alcohol.

EXAMPLE 7

Relatively Reactive Oxide in a Promoted System

In this series, 38 grams of Oxide "F", a relatively reactive grade of "active" magnesium oxide obtained from the Michigan Chemical Company, was employed, along with methanol and carbonated ammonium hydroxide as promoters. A somewhat different procedure was used, however, to vary the carbon dioxide addition rate. Inasmuch as the carbonated ammonium hydroxide solution contains appreciable amounts of dissolved carbon dioxide, a change in the amount added and/or the addition time has the effect of changing the rate at which $CO_2$ is added to the system. In this series, gaseous $CO_2$ from the rotameter was added at a rate of 130 mls/min. for all runs, and the amount of carbonated ammonium hydroxide solution was varied. The results are shown in Table VII.

TABLE VII

| Run Number | 1 | 2 | 3 | 4 | 5 |
|---|---|---|---|---|---|
| Magnesium Oxide "F", gms. | 38 | 38 | 38 | 38 | 38 |
| Neutral Magnesium Sulfonate Soln.* gms. | 145 | 145 | 145 | 145 | 145 |
| Xylene, mls. | 300 | 300 | 300 | 300 | 300 |
| Methanol, mls. | 35 | 35 | 35 | 35 | 35 |
| Water, total, mls. | 42 | 42 | 42 | 42 | 42 |
| $NH_4OH$ (29%), mls. | 0.40 | 0.75 | 1.5 | 2.5 | 5.0 |
| Carbonated $NH_4OH$-Water Addtion Time, min. | 30 | 30 | 30 | 30 | 30 |
| $CO_2$ Addition Rate, mls./min. | 130 | 130 | 130 | 130 | 130 |
| Final Product | | | | | |
| Recovery, gm. | 201.1 | 203.9 | 203.9 | 207.1 | 206.2 |
| Alkali Value (AV) | 428 | 445 | 450 | 454 | 455 |
| Vis. @ 210° F., cSt. | 102.0 | 113.9 | 118.1 | 122.0 | 102.2 |

*In this series a 50/50 mixture of the neutral magnesium sulfonate solution of Example 1 with an alkyl-benzene sulfonic acid obtained from Exxon, Inc. was used. The sulfonic acid was neutralized in situ by excess MgO.

With this relatively reactive oxide, the carbon dioxide addition rate of 130 mls/min. is already close to the critical carbonation rate, as indicated by the high AVs and low 210° F. viscosities of all five products. However, there is still a definite improvement observed when the amount of carbonated ammonium hydroxide is increased. This series also shows that the optimum amount of ammonium hydroxide promoter lies around 2.5–5 mls.

Run 5 was repeated, this time using 46.2 grams of Oxide "F". The resulting overbased sulfonate product had an AV of 515 and a 210° F. viscosity of 194.3 centistokes. This corresponds to a metal ratio of about 18.

This experiment again illustrates the improvement shown by our process over that of Gergel et al. Gergel teaches that, in order to prepare overbased additives with metal ratios in excess of 15, the overbasing should be carried out in a stepwise manner, wherein an overbased additive of intermediate metal ratio is prepared, isolated, mixed with more magnesium oxide, promoters, solvent, etc. and again treated with $CO_2$, and this procedure repeated until the desired metal ratio is achieved. Using our technique, overbased additives with metal ratios above 15 and AVs above 500 can be prepared in a single overbasing step, with viscosities and filterabilities similar to commercial products of much lower AVs.

EXAMPLE 8

Comparison of Aromatic and Aliphatic Hydrocarbon Solvents

This Example illustrates that our process is operable both with aliphatic and aromatic solvents. Oxide "G", a reactive magnesium oxide obtained from Van Waters & Rogers Company, was used in the following recipe:

| | |
|---|---|
| Oxide "G" | 38 grams |
| Neutral Magnesium Sulfonate Soln. | 290 grams |
| Hydrocarbon Solvent | 300 mls. |
| $NH_4OH$ (29%) | 5 mls. |
| Water | 42 mls. |
| Addition Time, Precarbonated | |
| $NH_4OH$ | 30 min. |
| $CO_2$ Rate | 130 mls./min. |

(The ammonium hydroxide-water was precarbonated in the usual way)

Two experiments were carried out, one with xylene, the other with a predominantly aliphatic hydrocarbon solvent, VM & P Naphtha. The results were as follows:

TABLE VIII

| | Aliphatic Solvent | Aromatic Solvent |
|---|---|---|
| Solvent | VM & P Naphtha | Xylene |
| Exother, min. | 160 | 170 |
| Total Time, hr. | 3.6 | 3.6 |
| Filtration Time, sec. | 100 | 243 |
| Final Product | | |
| Recovery, gm | 209.8 | 205.3 |
| Alkali Value (AV) | 457.5 | 455 |
| Viscosity @ 210° F. cSt. | 127.7 | 79.9 |

The $CO_2$ addition rate of 130 mls/min. was fairly close to the critical carbonation rate for Oxide "G" in this system as indicated by the excellent properties of the two products. The product prepared with the use of the aliphatic solvent had a slightly higher AV and better filterability. The product prepared with the aromatic solvent had a substantially better 210° viscosity. However, these results demonstrate that, unlike the process of the prior art reference Kemp, which is operable only with aliphatic solvents, our process is operable both with aliphatic and aromatic solvents.

EXAMPLE 9

Dead-Burned Oxide in a Promoted System

Oxide "H", obtained from the Basic Chemical Company, is a "heavy" or "dead-burned" magnesium oxide, and as such would not normally be considered to be suitable for overbasing. In the following series, it is compared with Oxide "B", an "active" magnesium oxide of relatively low reactivity in overbasing. The recipe was as follows:

| | |
|---|---|
| Oxide "H" or "B" | 40 grams |
| Neutral Magnesium Sulfonate Soln. | 145 grams |
| Xylene | 300 grams |
| $NH_4OH$ (29%) | 5 mls. |
| Water | 42 mls. |
| Methanol | 40 mls. |

(The ammonium hydroxide-water was precarbonated in the usual way)

The results of these runs are set out in Table IX.

TABLE IX

| | Oxide "H" | Oxide "B" | Oxide "H" | Oxide "B" |
|---|---|---|---|---|
| $NH_4OH$ Addition Time, min. | 60 | 60 | 30 | 30 |
| $CO_2$ Rate, mls/min. | 59 | 59 | 130 | 130 |
| Exotherm, mins. | 220 | 300 | 280 | 170 |
| Total Time, hr. | 5.0 | 5.7 | 5.0 | 4.0 |
| Product | | | | |
| Alkali Value (AV) | 43 | 349 | 25 | 170 |

Even in this promoted system, the dead-burned Oxide "H" has a very low reactivity, compared to active Oxide "B" (which itself has a relatively low reactivity, as shown in previous Examples). It is noteworthy, however, that decreasing the $CO_2$ rate from 130 to 59 mls/min., and increasing the addition time of the carbonated ammonium hydroxide solution (which has the effect of decreasing the rate of $CO_2$ addition) resulted in an AV increase of from 25 to 43. It is possible that, by further decreasing the rate of $CO_2$ feed and perhaps increasing the amount of oxide charged, a satisfactory overbased sulfonate product might be prepared from Oxide "H", but the reaction times required would probably be impractically long.

EXAMPLE 10

Magnesium Hydroxide in a Promoted System

Two attempts to use magnesium hydroxide instead of magnesium oxide in a recipe similar to that of Example 9, with different $CO_2$ addition rates, were almost completely unsuccessful. Products were obtained with AVs of only 6 and 3 respectively. Inasmuch as some magnesium hydroxide should be formed as a transient intermediate when water is added to magnesium oxide in our process, this failure of magnesium hydroxide itself to react is somewhat surprising.

EXAMPLE 11

Bench Scale Pilot Unit, Stirred Reactor, Pump Recirculation. Relatively Reactive Oxide in a Promoted System This series illustrates the use of the critical carbonation techniques in a bench-scale pilot unit comprising a 1-liter resin kettle equipped with agitatior, $CO_2$ inlet, thermometer, and a bottom draw from which the contents of the flask can be continuously circulated through a pump and back into the top of the reactor. The ammonium hydroxide solution, carbonated to a phenolphthalein-barium chloride end point, is added from a burette into the circulation line just ahead of the suction side of the pump. The oxide employed in this series was Oxide "E", a relatively reactive "active" magnesium oxide supplied by the Van Waters & Rogers Company.

The neutral magnesium sulfonate solution in diluent oil was the same as was used in Example 1.

The reactions were run as follows: 76 grams of oxide, 290 grams of neutral magnesium sulfonate solution, 600 milliliters of xylene, and 80 milliliters of methanol were charged to the resin kettle. Agitation, circulation, and addition of $CO_2$ were begun while a mixture of 10 milliliters of concentrated (29%) ammonium hydroxide in 84 milliliters of water, carbonated to a phenolphthalein-barium chloride end point, was introduced through the burette into the circulating line. The results were as follows:

TABLE X

| Run Number | 1 | 2 | 3 | 4 | *5 | 6 |
|---|---|---|---|---|---|---|
| $CO_2$ Addition Rate, mls/min. | 202 | 132 | 105 | 105 | 105 | 80 |
| $NH_4OH$ Feed Time, mins. | 60 | 60 | 60 | 120 | 60 | 60 |
| Final Product | | | | | | |
| Alkali Value (AV) | 183 | 278 | 278 | 226 | 420 | **144 |
| Viscosity @ 210° F., cSt. | — | 36.45 | 42.44 | 37.38 | 65.14 | — |
| Filtration Time, mins. | 4¾ | 37¾ | 75 | 2 | 11 | — |

Notes:
*MgO increased to 94.4 gms
**Hazy and therefore unacceptable

It appears that the critical carbonation rate for this magnesium oxide in this particular overbasing reaction mixture lies around 105–132 mls. per minute. Hazy or difficulty filterable products were obtained at lower $CO_2$ addition rates. This Example demonstrates that the technique of our invention may be applied to different configurations of equipment.

The above Examples illustrate the application of the critical carbonation rate technique of our invention to the preparation of overbased magnesium sulfonates from a variety of "active" grades of magnesium oxide. The overbased products thus formed are useful in a vast variety of lubricating oils, hydraulic and functional fluids, greases and fuels, and especially in automobile crankcase oils. Numerous modifications in reaction conditions—e.g. water and promoter concentrations, dispersing agents, reaction temperature, agitation, $CO_2$ pressure, etc.—may be made without departing from the scope of our invention. The above Examples are offered for the purpose of illustration only, and are not meant to be limiting within the boundaries of the following claims.

We claim:

1. In the process of preparing overbased magnesium additive by the reaction of commercial grades of magnesium oxide with carbon dioxide and water in the presence of an oil-soluble dispersing agent, the improvement comprising:

(1) forming a mixture of oil-soluble dispersing agent, low boiling hydrocarbon solvent, diluent oil, water, and a commercial magnesium oxide in excess of the amount theoretically required to produce an overbased magnesium additive product of the desired alkali value;

(2) adding thereto carbon dioxide, at the critical carbonation rate, said critical carbonation rate being defined as that rate of carbon dioxide addition necessary to maintain such a $CO_2$ concentration in the system that the rate of conversion of magnesium oxide to colloidally dispersed magnesium carbonate is at a maximum relative to the rate of conversion of magnesium oxide to undispersed reaction products, and continuing said carbon dioxide addition until the reaction of carbon dioxide and magnesium oxide is substantially completed;

(3) removing from the carbonated reaction mixture water, low boiling hydrocarbon solvent, and undispersed solids, thereby recovering the overbased magnesium additive product in the form of a clear submicronic colloidal dispersion in the diluent oil.

2. The process of claim 1 wherein the oil-soluble dispersing agent is selected from the group consisting of oil-soluble sulfonic acids and the alkaline earth metal salts thereof.

3. The process of claim 2 wherein the water is added to the mixture of neutral sulfonate, diluent oil, low-boiling hydrocarbon solvent, and magnesium oxide when the introduction of the carbon dioxide is begun, and wherein the addition of said water is carried out over a period of from about 2 to about 25% of the total reaction time.

4. The process of claim 1 wherein the reactivity of the magnesium oxide is increased by the addition thereto of a promoter selected from the group consisting of low-boiling alcohols and alkoxy alcohols and amino alkoxy alcohols.

5. The process of claim 4 wherein the promoter is methanol.

6. The process of claim 1 wherein the reactivity of the magnesium oxide is increased by the addition thereto of a promoter selected from the group consisting of ammonia and amines and salts thereof.

7. The process of claim 6 wherein the promoter is ammonia.

8. The process of claim 7 wherein the promoter is ammonia added to the reaction mixture in the form of a dilute solution of ammonium hydroxide carbonated to a phenolphthalein-barium chloride end point.

9. The process of claim 1 wherein ammonium hydroxide is added to the water and carbonated to the phenolphthalein-barium chloride end point before said water is added to the overbasing reaction mixture.

10. The process of claim 3 wherein ammonium hydroxide is added to the water and carbonated to the phenolphthalein-barium chloride end point before said water is added to the overbasing reaction mixture.

11. The process of claim 10 wherein methanol is added to the overbasing reaction mixture as an additional promoter.

12. The process of claim 1 wherein the low-boiling hydrocarbon solvent is selected from the group consisting of xylene, toluene, octane, and varnish maker's and painter's naphtha.

13. A method of determining the critical carbonation rate for a given commercial magnesium oxide in a given overbasing reaction mixture, said critical carbonation rate being defined as that rate of carbon dioxide addition necessary to maintain such a $CO_2$ concentration in the system that the rate of conversion of magnesium oxide to colloidally dispersed magnesium carbonate is at a maximum relative to the rate of conversion of magnesium oxide to undispersed products, said method comprising the following steps:

(1) forming a mixture of:

(a) a commercial magnesium oxide, in an amount of from about 15% to about 400% in excess of that theoretically required to produce an overbased magnesium sulfonate product of the desired alkali value;

(b) an oil-soluble neutral sulfonate dispersing agent in an amount necessary to give a concentration of from about 20 to about 30% in the final overbased product;

(c) a diluent oil in an amount necessary to give a concentration of from about 30 to about 50% in the final overbased product;

(d) a low boiling hydrocarbon solvent, in an amount equal to from about 70 to about 130% of the weight of the rest of the reactants;

(2) subjecting the mixture of Step 1 to agitation sufficient to maintain the magnesium oxide in a state of suspension and adding thereto:

(a) water in an amount of from about 0.2 to about 1.2 times the weight of magnesium oxide present; and (b) carbon dioxide, at a rate theoretically sufficient to convert all of the magnesium oxide to magnesium carbonate in some arbitrarily chosen reaction period, until the reaction of the $CO_2$ with the magnesium oxide is substantially complete;

(3) removing from the carbonated reaction mixture water, low-boiling hydrocarbon solvent, and undispersed solids, and determining the alkali value of the submicronic colloidal dispersion of overbased magnesium sulfonate in diluent oil obtained thereby; and (4) repeating Steps 1 through 3, using lower and higher rates of carbon dioxide addition until that rate has been found which yields the overbased sulfonate product with the highest alkali value.

14. The process of claim 13 wherein the water is added to the mixture of neutral sulfonate, diluent oil, low-boiling hydrocarbon solvent, and magnesium oxide when the introduction of the carbon dioxide is begun, and wherein the addition of said water is carried out over a period of from about 2 to about 25% of the total reaction time.

15. The process of claim 14 wherein the water contains as a promoter from about 2 to about 7% ammonium hydroxide and is carbonated to the phenolphthalein-barium chloride end point.

16. The process of claim 14 wherein methanol in an amount equal to about 0.5 to 1.5 times the volume of the water used is added to the reaction mixture as a promoter.

17. The process of claim 15 wherein methanol in an amount equal to about 0.5 to 1.5 times the volume of the water used is added to the overbasing reaction mixture as an additional promoter.

18. A method of preparing an overbased magnesium sulfonate with an alkali value of 400 or higher, said method comprising the following steps:

(1) forming a mixture of:

(a) a commercial magnesium oxide, in an amount of from about 15% to about 400% in excess of that theoretically required to produce an overbased magnesium sulfonate product of the desired alkali value;

(b) an oil soluble neutral sulfonate dispersing agent in an amount necessary to give a concentration of from about 20 to about 30% in the final overbased product;

(c) a diluent oil in an amount necessary to give a concentration of from about 30 to about 50% in the final overbased product;

(d) a low-boiling hydrocarbon solvent, in an amount equal to from about 70 to about 130% of the weight of the rest of the reactants;

(2) subjecting the mixture of Step 1 to agitation sufficient to maintain the magnesium oxide in a state of suspension and adding thereto:

(a) water in an amount of from about 0.2 to about 1.2 times the weight of magnesium oxide present; and (b) carbon dioxide at the critical carbonation rate for that particular magnesium oxide in that particular overbasing reaction mixture, the carbon dioxide being added until the reaction of the carbon dioxide with the magnesium oxide is substantially complete;

(3) at the conclusion of the carbon dioxide addition, removing from the carbonated reaction mixture water, low-boiling hydrocarbon solvent, and undispersed solids, thereby recovering the overbased magnesium sulfonate product as a solution in the diluent oil.

19. The process of claim 18 wherein the water is added to the mixture of neutral sulfonate, diluent oil, low-boiling hydrocarbon solvent, and magnesium oxide when the introduction of the carbon dioxide is begun, and wherein the addition of said water is carried out over a period of from about 2 to about 25% of the total reaction time.

20. The process of claim 19 wherein the water contains as a promoter from about 2 to about 7% ammonium hydroxide and is carbonated to the phenolphthalein-barium chloride end point.

21. The process of claim 19 wherein methanol in an amount equal to about 0.5 to 1.5 times the volume of water used is added to the reaction mixture as a promoter.

22. The process of claim 20 wherein methanol in an amount equal to about 0.5 to 1.5 times the volume of water used is added to the overbasing reaction mixture as an additional promoter.

* * * * *